US008397809B2

(12) United States Patent
Jeffryes

(10) Patent No.: US 8,397,809 B2
(45) Date of Patent: Mar. 19, 2013

(54) TECHNIQUE AND APPARATUS TO PERFORM A LEAK OFF TEST IN A WELL

(75) Inventor: Benjamin P. Jeffryes, Histon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 234 days.

(21) Appl. No.: 11/876,914

(22) Filed: Oct. 23, 2007

(65) Prior Publication Data

US 2009/0101340 A1 Apr. 23, 2009

(51) Int. Cl.
*E21B 47/10* (2012.01)

(52) U.S. Cl. ..... 166/250.08

(58) Field of Classification Search ..... 73/1.16, 73/1.25; 166/250.08
See application file for complete search history.

(56) References Cited

U.S. PATENT DOCUMENTS

| | | | | |
|---|---|---|---|---|
| 2,343,076 | A * | 2/1944 | Otis et al. | 166/127 |
| 5,554,805 | A * | 9/1996 | Bahrton | 73/202 |
| 6,176,323 | B1 * | 1/2001 | Weirich et al. | 175/40 |
| 6,223,826 | B1 * | 5/2001 | Chau et al. | 166/380 |
| 6,378,363 | B1 * | 4/2002 | Hache et al. | 73/152.46 |
| 6,427,785 | B2 | 8/2002 | Ward | |
| 6,918,440 | B2 | 7/2005 | Garcia-Soule et al. | |
| 7,147,059 | B2 * | 12/2006 | Hirsch et al. | 166/372 |
| 7,172,038 | B2 * | 2/2007 | Terry et al. | 175/45 |
| 7,397,388 | B2 * | 7/2008 | Huang et al. | 340/853.3 |
| 8,146,416 | B2 * | 4/2012 | Pisio et al. | 73/152.51 |
| 2002/0011333 | A1 | 1/2002 | Ward | |
| 2004/0065477 | A1 * | 4/2004 | Paulk et al. | 175/50 |
| 2005/0115741 | A1 | 6/2005 | Terry et al. | |

FOREIGN PATENT DOCUMENTS

| | | |
|---|---|---|
| GB | 2410511 | 3/2005 |
| WO | 03042488 | 5/2003 |
| WO | 2006099362 | 9/2006 |

OTHER PUBLICATIONS

Manning, Michael J., Processing Wired Pipe LWD-FE Data in Real Time—Experiences and Lessons Learned, SPWLA 48th Annual Logging Symposium, Jun. 3-6, 2007, Austin, Texas, pp. 1-9.

Dalton, The Benefits of Real-Time Downhole Pressure and Tension Data with Wired Composite Tubing, Journal of Canadian Petroleum Engineering, vol. 42, No. 5, May 2003, pp. 67-77.

* cited by examiner

*Primary Examiner* — William P Neuder
*Assistant Examiner* — Kipp Wallace
(74) *Attorney, Agent, or Firm* — John Vereb; David J. Smith; Brigitte Jeffery Echols

(57) ABSTRACT

A technique that is usable with a well includes deploying at least one sensing device in the well and during a leak off test, communicating a signal that is indicative of a measurement that is acquired by the sensing device(s) over a wired infrastructure of a drill string. The technique includes controlling the leak off test based at least in part on the communication.

12 Claims, 3 Drawing Sheets

TECHNIQUE AND APPARATUS TO PERFORM A LEAK OFF TEST IN A WELL

BACKGROUND

The invention generally relates to a technique and apparatus to perform a leak off test in a well.

A typical system for drilling an oil or gas well includes a tubular drill pipe, called a "drill string," and a drill bit that is located at the lower end of the string. During drilling, the drill bit is rotated to remove formation rock, and a drilling fluid called "mud" is circulated through the drill string for such purposes as removing thermal energy from the drill bit and removing debris that is generated by the drilling. A surface pumping system typically generates the circulating mud flow by delivering the mud to the central passageway of the drill string and receiving mud from the annulus of the well. More specifically, the circulating mud flow typically travels downhole through the central passageway of the drill string, exits the drill string at nozzles that are located near the drill bit and returns to the surface pumping system via the annulus. A downhole mud pulse telemetry tool of the drill string may modulate the circulating mud flow for purposes of communicating information to the surface relating to sensed downhole formation properties, the orientation of the drill string, etc.

One technique to rotate the drill bit involves applying a rotational force to the drill string at the surface of the well to rotate the drill bit at the bottom of the string. Another conventional technique to rotate the drill bit takes advantage of the mud flow through the drill string by using the flow to drive a downhole mud motor, which is located near the drill bit. The mud motor responds to the mud flow to produce a rotational force that turns the drill bit.

The drilling of the wellbore may be interlaced with operations to install segments of a casing string, which lines and supports the wellbore. More specifically, the drilling and casing installation operations may involve the following repetitive sequence: a particular segment of the wellbore is drilled; a casing section is next run and cemented in the newly drilled segment of the wellbore, and thereafter, the drilling of the next wellbore segment may begin.

During drilling, care typically is exercised to prevent the downhole pressure that is exerted by the drilling mud from exceeding a fracture initiation pressure of the formation. More specifically, if the downhole pressure that is exerted by the drilling mud exceeds the fracture initiation pressure, the formation that is exposed to this pressure begins to physically break down and allow mud to flow into the fractured formation. Such a condition may result in damage to the formation as well as create a hazardous drilling environment. Therefore, after the casing shoe (the lower bullnose end) of the most recently installed casing string segment is drilled out by the drill bit a test called a formation integrity test, or "leak off test" (LOT), typically is performed for purposes of determining the fracture initiation pressure for the next segment of the wellbore to be drilled. The LOT also provides a way to test the integrity of the cementing on the most recently installed casing section.

A typical LOT involves sealing off the annulus of the well and introducing drilling mud at a relatively slow and constant volumetric rate through the central passageway of the drilling string so that the mud exits the string near the string's bottom end and enters the bottom hole region of the well. During the LOT, the introduction of the mud flow gradually increases the bottom hole pressure due to the sealed annulus. The pumping of the drilling mud continues until either a predetermined test pressure is reached or the loss of drilling fluid into the formation is detected. The pressures and flow rates associated with the LOT typically are measured using sensors that are located at the surface of the well.

SUMMARY

In one aspect, a technique that is usable with a well includes deploying at least one sensing device in the well and during a leak off test, communicating a signal that is indicative of a measurement that is acquired by the sensing device(s) over a wired infrastructure of a drill string. The technique includes controlling the leak off test based at least in part on the communication.

In another aspect, a system that is usable with a well includes a drill string, at least one sensing device and a telemetry interface. The telemetry interface transmits a signal to a wiring infrastructure of the drill string during a leak off test, and the signal is indicative of a measurement that is acquired by the sensing device(s).

In yet another aspect, an apparatus that is usable with a well includes at least one sensing device and a telemetry interface. The telemetry interface transmits a signal to a wiring infrastructure of a drill string during a leak off test, and the signal is indicative of a measurement that is acquired by the sensing device(s).

Advantages and other features of the invention will become apparent from the following drawing, description and claims.

DETAILED DESCRIPTION

Figure 1:
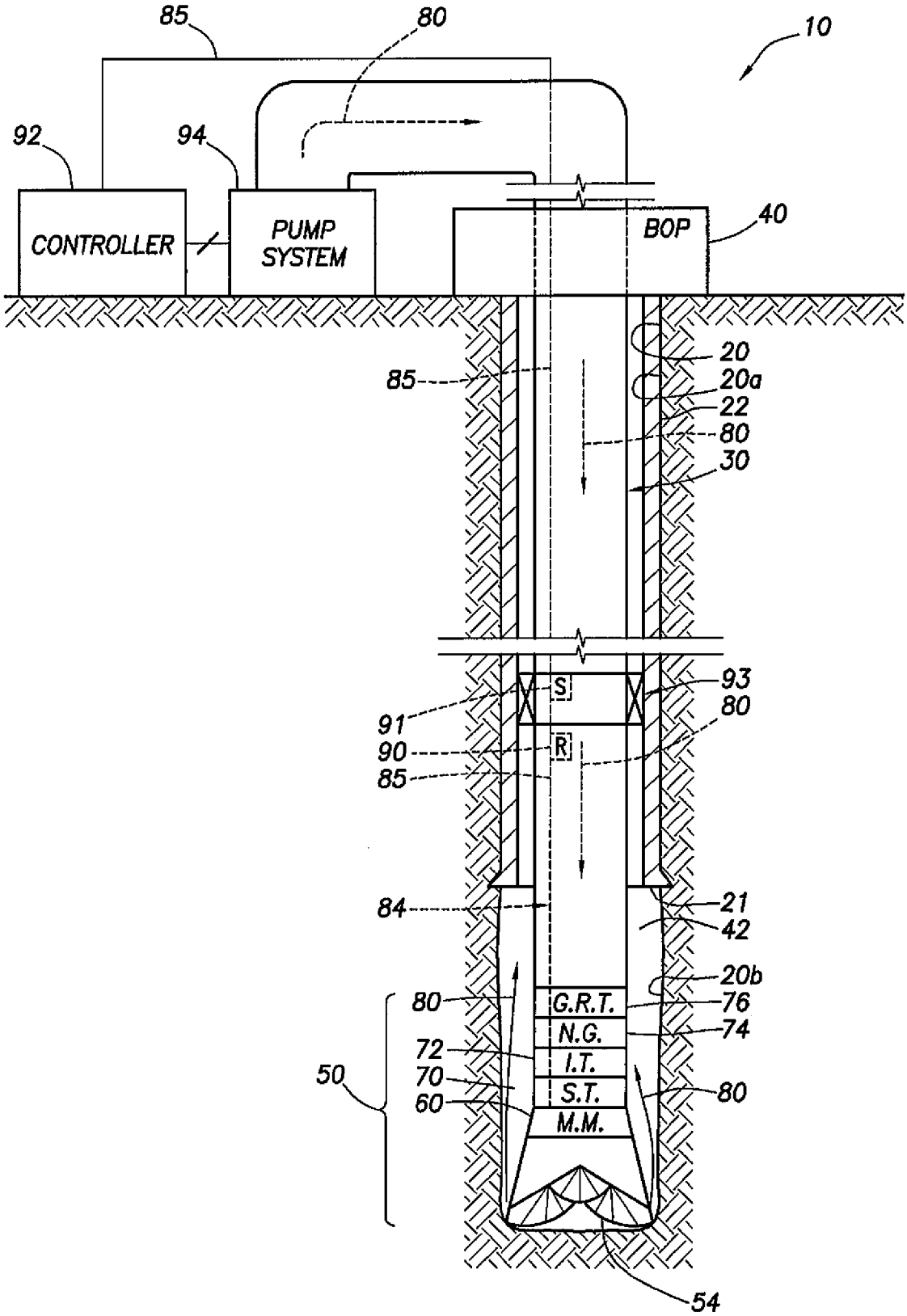
FIG. 1 is a schematic diagram of a drilling system according to an example.

According to one example, FIG. 1 schematically depicts a drilling system 10 that employs a wired drill pipe (WDP) infrastructure to communicate downhole measurements uphole during a leak off test (LOT). The LOT may be performed for such purposes as determining a fracture initiation pressure of a formation located near the bottom of a wellbore 20.

More specifically, FIG. 1 depicts a particular stage of a well during its drilling and completion. In this stage, an upper segment 20*a* of the wellbore 20 has been formed through the operation of a drill string 30, and the wellbore segment 20*a* is lined with and supported by a casing string 22 that has been cemented in the segment 20*a*. An initial portion of a lower, uncased segment 20*b* of the wellbore 20 has also been formed by a drill string 30. In particular, for the depicted stage, a drill bit 54 of the drill string 30 has drilled through a casing shoe at a lower end 21 of the casing string 22 and has formed the beginning of the wellbore segment 20*b*.

The LOT may be performed before drilling of the wellbore segment 20*b* continues so that the drilling operation may be controlled with knowledge of a fracture initiation pressure for the segment 20*b*, i.e., the pressure at which the formation that is associated with the segment 20*b* begins to fracture. The LOT also allows an assessment of the cementing of the mostly-recently installed casing string section.

To perform the LOT, communication through the well annulus that surrounds the drill string 30 is closed off for purposes of allowing the bottom hole pressure (i.e., the pressure in an uncased bottom hole region 42) to increase in response to an incoming flow that is introduced from the surface of the well. As one example, a blowout preventer (BOP) 40 of the system 10 may be operated to close, or seal, the annulus of the well at the surface. After the annulus is closed, a surface pump system 94 is operated to establish a relatively constant and small volumetric rate mud flow 80 into the well. Due to the closed off annulus, the pump system 94 does not receive a return mud from the well during the LOT.

The mud flow is introduced at the surface of the well into the central passageway of the drill string 30, routed downhole through the string's central passageway to flow nozzles (not shown) that are located near the string's lower end, and delivered via the nozzles to the bottom hole region 42 of the well. In general, the pumping of the mud into the well continues until one or more measured downhole parameters indicate that fluid is being lost into the formation or fluid is being lost outside of the casing string 22 due to an insufficient cementing job around the casing string 22. The latter cause typically is indicated early on in the test, as fluid loss outside of the casing string 22 due to an insufficient cementing job occurs at a relatively low pressure.

Conventionally, the LOT may rely entirely on surface data, i.e., flow rate and pressure measurements that are acquired by sensors that are located at the surface of the well. Alternatively, a conventional LOT may use recorded data, such as data that is recorded by sensors on the drill string during the LOT and retrieved from the sensors when the drill string is retrieved from the well after completion of the LOT. Another technique to perform a LOT may involve using mud pulse telemetry to communicate measurements that are acquired by downhole sensors to the surface of the well.

Certain challenges exist when the above-described conventional techniques are used to conduct a LOT. More specifically, surface measurements may not accurately indicate downhole pressures or flow rates. In this regard, when surface pressure measurements are used, the measured pressure at the surface of the well typically is corrected in an attempt to compensate for estimated hydrostatic and frictional pressure gradients within the well. Additionally, the well, being a hydraulic system, filters out high frequencies, thereby causing a surface pressure sensor to measure a smoothed version of the bottom hole pressure over time.

In general, there are at least three different flow rates that may be considered in the LOT: the flow rate of fluid into the drill string at the surface; the flow of the fluid through the nozzles or other exit points of the drill string, near the bottom of the wellbore; and the flow rate of fluid into the formation. The differences between these flow rates are attributable to the compliance of the fluid. In this regard, as the bottom hole pressure increases during the LOT, some of the flow into the top of the drill string is used to compress the fluid and does not emerge at the bottom of the drill string. A much larger effect is attributable to the flow out of the bottom of the drill string mainly being used to compress the fluid in the annulus until the formation fractures, and due to this compression, a surface measured flow rate may be relatively inaccurate. It has therefore been discovered that a more accurate determination of the fracture initiation pressure involves using downhole sensors to measure downhole parameters, such as the flow rate near the drill bit 54 where the mud flow exits the drill string 30 and the flow rate outside of the drill string 30 (in the annulus of the well).

In a variation on the standard LOT procedure, a method known as the hesitation LOT does not attempt to pump at a constant rate, but instead consists of pumping small volumes of fluid (typically half a barrel) at a time, and then waiting until the pressure has stabilized before pumping the next volume. Wired pipe is particularly advantageous in such a test, as the improved response time and band-width of the downhole measurement allows quicker and more positive confirmation of stabilization of downhole conditions, and if fluid is starting to leak off (hence reducing the pressure), faster and better identification that the leak-off pressure has been reached.

The conventional technique of recording downhole measurements using sensors on the drill string and then subsequently retrieving the recorded measurements when the drill string is removed from the well does not allow the LOT to be controlled in "real time" in response to these measurements. Using mud pulse telemetry to communicate data acquired by downhole sensors to the surface introduces certain challenges as well, as the mud pulse telemetry typically has a limited bandwidth and requires a circulation flow to the surface of the well, which is not available during the LOT due to the closure of the annulus. Thus, mud pulse telemetry also does not allow the LOT to be controlled in real time in response to downhole measurements.

In accordance with examples that are described herein, a LOT is conducted based on real time measurements that are acquired by downhole sensing devices and are communicated uphole to the surface of the well using a wired infrastructure of the drill string 30. More specifically, in one example, the drill string 30 has a wired drill pipe (WDP) infrastructure 84, herein called the "wired infrastructure 84," which includes (as a non-limiting example) wire segments 85 that are embedded in the housing of the drill pipe 30 and may include various repeaters 90 (one repeater being depicted in FIG. 1) along the drill string's length to boost the signals between wire segments 85. As an example, the drill string 30 may be formed from jointed tubing sections, with each section having one or more wire segments 85, possibly a repeater 90 and electrical contacts on either end to form electrical connections with the adjacent jointed tubing sections. As another example, the drill string 30 may be a coiled tubing string that has the wired infrastructure 84 embedded in the housing of the string.

As compared to conventional LOT systems, the wired infrastructure 84 allows real time and relatively high bandwidth communication of downhole measurements to the surface of the well during the LOT for purposes of controlling the LOT in response to these measurements and more accurately determining downhole characteristics, such as the fracture initiation pressure. The availability of high bandwidth communication during the LOT allows faster sampling rates and higher resolutions for the measurements that are acquired by the downhole sensing devices.

As a more specific example, the drill bit 54 may be part of a bottom hole assembly (BHA) 50 of the drill string 30, which also includes various sensing devices to acquire measurements that are indicative of various downhole parameters, such as pressures, flow rates, resistivities, formation compression/shear velocities, etc. A sensing tool 70 that may acquire various pressures and flow rates is one example of a tool that may contain various sensing devices. The measurements that are acquired by the sensing tool 70 are communicated uphole to the surface via the wired infrastructure 84. Thus, an operator at the surface of the well may monitor the measured downhole parameters during the LOT and operate a surface controller 92 to regulate the pump system 94 accordingly.

As another example, the controller 92 may regulate the pump system 94 during the LOT in an automated fashion based on the downhole measurements that are received by the controller 92. The controller 92 may also use the wired infrastructure 84 to direct operations of one or more of the downhole sensing devices. Thus, many variations are contemplated and are within the scope of the appended claims.

The drill string 30 may include, as examples, other sensing devices to acquire downhole measurements during a LOT, such as an imaging tool 72 and a gamma ray detection tool 76 that works in conjunction with a neutron generator 74, as further described below, to measure a flow rate.

The BHA 50 depicted in FIG. 1 is simplified for purpose of emphasizing certain aspects of the BHA 50 relating to the LOT. Thus, the BHA 50 may have various other components, such as a bent sub, a stabilizer, drill collars, a mud pulse telemetry tool, an under reamer, etc., as can be appreciated by one of ordinary skill in the art. As shown in FIG. 1, the BHA 50 may include a mud motor 60 that rotates the drill bit 54 in response to a pressurized mud circulation flow. It is noted that the mud flow during the LOT has a significantly smaller flow rate than the mud flow rate during drilling operations.

As further described below, the drill string 30 may include a packer 93 (shown as being radially expanded, or set, in FIG. 1) to isolate the bottom hole region 42 of the formation being tested to limit the volume that receives the mud flow during the LOT. Thus, instead of introducing and pressurizing fluid in the entire well annulus (up to the BOP 40), the pressurized region only extends from the bottom of the wellbore 20 to the packer 93.

Figure 2:
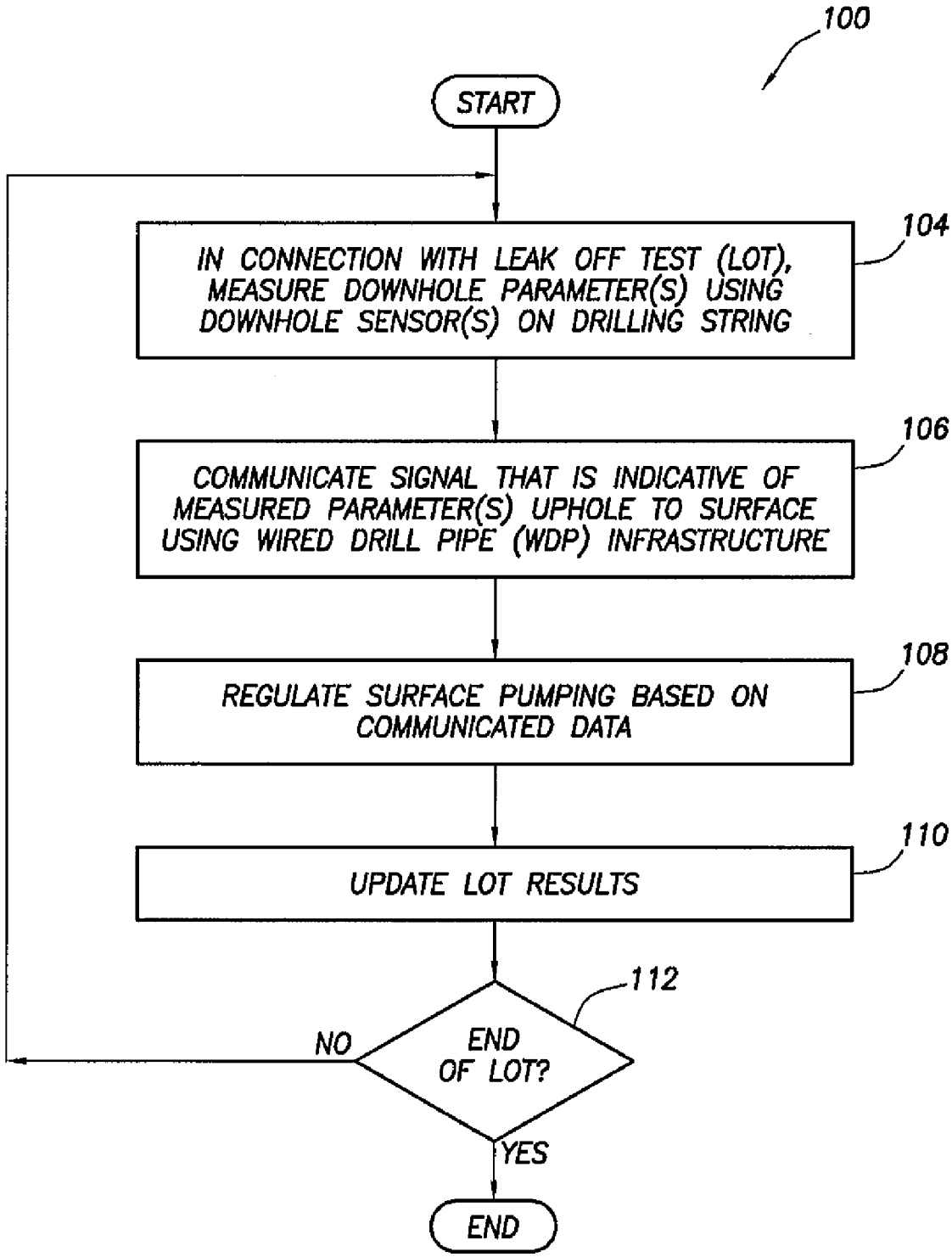
FIG. 2 is a flow diagram depicting a technique to perform a leak off test according to an example.

Referring to FIG. 2, to summarize, a technique 100 to perform a LOT includes measuring one or more downhole parameters using one or more downhole sensing devices that are deployed on a drill string, pursuant to block 104. A signal that is indicative of the measured parameter(s) is communicated (block 106) uphole to the surface of the well using a wired drill pipe (WDP) infrastructure. The surface pumping associated with the LOT is regulated, pursuant to block 108, based on the communicated measurement(s). The LOT results may then be updated (block 110) and control transitions to diamond 112. In diamond 112 of the technique 100, a determination is made whether an end of the LOT has been reached. For example, determining the end of the LOT may involve determining that the fracture initiation pressure has been reached based on the measured parameter(s). Alternatively, the end of the LOT test may be indicated by the bottom hole pressure reaching a predetermined threshold or may be indicated by the detection of a premature loss of drilling fluid, which is indicative of insufficient cementing around the casing string 22.

Figure 3:
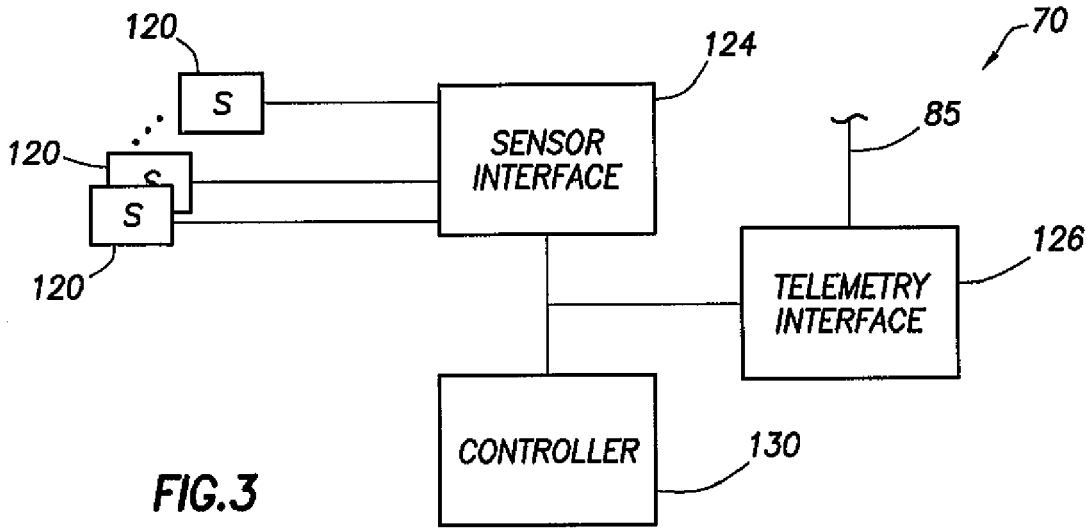
FIG. 3 is a block diagram of a sensor tool of the drill string of FIG. 1 according to an example.

Referring to FIG. 3, as an example, the sensing tool 70 may include sensors 120, which are sensing devices that measure various downhole parameters, such as various pressures and/or flow rates, and provide signals indicative of the measurements. For example, one of the sensors 120 may monitor a pressure at the drill string's exit nozzles near the drill bit 54, and another sensor 120 may measure an annulus pressure in the region 42. The measurement data that is acquired by these sensors 120 may be communicated to a sensor interface 124, which may contain sample and hold (S/H) circuitry, analog-to-digital converters (ADCs), etc., for purpose of conditioning the signals that are provided by the sensors 120 into the appropriate form for processing or for uphole communication via a telemetry interface 126. The telemetry interface 126 is constructed to further transmit one or more signals to a wire segment 85 of the infrastructure 84 for purposes of communicating acquired measurements uphole to the surface of the well.

A controller 130 (one or more microprocessors and/or microcontrollers, as examples) of the sensor tool 70 may process some of the measurement data before transmission uphole. For example, the controller 130 may apply the Bernoulli equation to the above-described pressure measurements from the sensors 120 (i.e., the pressure measurements at the nozzles and in the annulus) to derive a rate at which the flow exits the nozzles. Thus, two sensors 120 effectively acquire one measurement, a flow rate measurement, for this example. The determined flow rate measurement may be communicated uphole via the telemetry interface 126. Alternatively, the flow rate may be calculated from pressure measurements that are communicated over the wired infrastructure 84 to the surface of the well.

The telemetry interface 126 may be constructed to establish bidirectional communication. In this regard, as described above, in the uphole communication direction, the telemetry interface 126 transmits signals to the wired infrastructure 84 for purposes of communicating the acquired downhole measurements to the surface of the well. In the downhole communication direction, the telemetry interface 126 receives one or more signals via the wired infrastructure 84, which are indicative of commands for the sensor tools 70 and possibly other downhole sensor tools/sensing devices. For example, the sensor tool 70 may be remotely instructed from the surface of the well regarding when and how to conduct downhole measurements.

Figure 4:
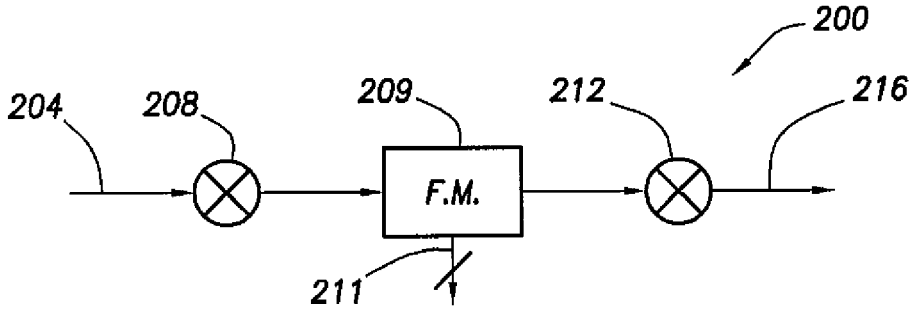
FIG. 4 is a block diagram of a flow rate sensing path according to an example.

As an alternative to sensing pressure data and extracting flow rate information from the pressure data, the sensing tool 70 may include a flow rate sensing path 200 that is depicted in FIG. 4 for purposes of directly measuring the flow rate through the string's exit nozzles. In this regard, the flow rate sensing path 200 may be an alternative path (to the central passageway of the drill string 30) that includes an inlet 204, an outlet 216 and a flow meter 209 in between to detect a flow rate through the path 200. More specifically, the controller 130 (see FIG. 3) may control valves 208 and 212 to control when flow passes through the flow meter 209. The flow meter 209 may provide a signal (via one or more electrical wires 211) that is received by the sensor interface 124 (FIG. 3) and indicates the measured flow rate. Alternatively, the flow rate sensing path may always be connected to receive part of the mud flow, and the measurements from the flow meter 209 may be ignored or not communicated uphole except during the LOT (as non-limiting examples).

An alternative flow path may also be employed in scenarios when the two sensors 120 are used to acquire pressure data, which is used to extract the flow rate information. In this manner, the flow rate through the exit nozzles may be too small to accurately determine the flow rate from the pressure measurements. Therefore, by routing the flow through an alternative flow path that has a small cross-sectional size, the pressures are increased for a more accurate measurement.

Returning back to FIG. 1, for purposes of determining the flow rate in the region 42, the neutron generator 74 converts $O_{16}$ atoms in the mud flow to $N_{16}$ atoms before the atoms exit the nozzles of the drill string 30. The neutron generator 74 may be intermittently or continuously operated. The gamma ray detection tool 76 senses or measures the decay of the $N_{16}$ atoms, and the measured decay may be used to determine the flow rate through the region 42. Knowledge of the flow rate out of the drill string nozzles and the annulus flow rate through the region 42 allows a determination of the flow rate (if any) into the formation.

As examples, the time-of-flight or intensity methods may be used to determine the flow rate from the measurements made by the gamma ray detection tool 76. The flow rate based on the measurements by the gamma ray detection tool 76 may be determined downhole by the controller 130 (see FIG. 3) via the wired infrastructure 84 and then communicated uphole via the wired infrastructure 84; or alternatively, the gamma ray detection tool measurement data may be communicated uphole to the surface of the well, where the flow rate is determined.

The BHA 50 may include an imaging tool 72. As an example, the imaging tool 72 may be an acoustic imaging tool that includes a transducer to generate an acoustic signal that propagates into the surrounding formation and includes acoustic sensors to measure the corresponding acoustic response. In this regard, as the formation rock is pressurized during the LOT but before a fracture forms, there are measurable changes to the rock around the borehole 22, especially to the acoustic properties of the rock. For example, the compressional and shear velocities of the formation both change as functions of distance from the borehole and in general as a function of the azimuth. After a slight fracture has been initiated, the fracture may be observed by observing changes to the rock's acoustic properties, as indicated by the measurements that are acquired by the imaging tool 72 and communicated to the surface of the well. It is noted that the data that is acquired by the imaging tool 72 may be communicated uphole during the LOT via the wired infrastructure 84. As examples, the imaging may be performed before and after the LOT to identify the zone in which a fracture has been initiated. The imaging tool, as one example, may be positioned relatively close to the bit 54.

It is noted that the imaging tool 72 may use technology other than acoustic-based imaging. As other non-limiting examples, the imaging tool 72 may be a camera or may be a tool that measures the resistivity of the formation.

Figure 5:
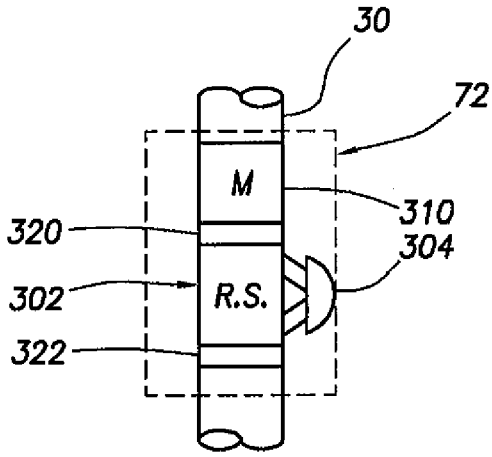
FIG. 5 is a schematic diagram of an imaging tool of the drilling system of FIG. 1 according to an example.

As a more specific example, referring to FIG. 5, the imaging tool 72 may include a resistivity sensor 302 that acquires data that is indicative of the resistivity of a particular section of the formation in contact with a contact pad 304. A motor 310 of the imaging tool 72 may be activated (via a command that is transmitted over the wired infrastructure 84, for example) to rotate the resistivity sensor 302 and the associated pad 304. As depicted in FIG. 5, the resistivity sensor 302 may be connected in line with the drilling string 30 via swivel connections 320 and 322, which permit rotation of the resistivity sensor 302 about the local longitudinal axis of the drill string 30 when the motor 310 is activated.

The motor 310 may be an electric motor (that receives power via a downhole battery or via wiring in the drill pipe 30), a hydraulically-driven motor or a motor that converts the mud flow produced during the LOT into a rotational force to drive the rotation of the resistivity sensor 302, as just a few non-limiting examples. Thus, many variations are contemplated and are within the scope of the appended claims.

As yet another example of a sensing device, the BHA 50 may include a formation pressure measurement tool, such as a formation tester while drilling tool, to acquire measurements during the LOT. These measurements, in turn, may be communicated in real time to the surface of the well, using the wired infrastructure 84 of the drill string 30.

Referring back to FIG. 1, the packer 93 may be set (as shown in FIG. 1) to isolate the bottom hole region 42 from the annular space above the packer 93 to reduce the volume (and thus, the amount of the drilling fluid) that is subject to the LOT. As shown in FIG. 8, the packer 93 may be positioned sufficiently high on the drill string 30 such that the packer 30 is in position to form a seal between the drill string 30 and interior surface of the casing string 22. Alternatively, as another example, the packer 93 may be positioned lower on the drill string 30 to form a seal with the uncased borehole segment 20*b*. Thus, many variations are contemplated and are within the scope of the appended claims.

The packer 93 may include a sensor 91 to measure the pressure above the packer 93. The measurement that is acquired by the sensor 91 may be communicated uphole during the LOT via the wired infrastructure. This measured pressure, along with the pressure that is measured below the packer 93 using one of the above-described sensors, permits a control scheme that is designed to minimize the pressure differential across the packer's annular seal. Thus, above the packer 93, fluid may be pumped into the annulus (via a circulation valve (not shown) of the drill string 30, for example) during the LOT for purposes of maintaining a relatively low pressure differential across the packer 93 as the bottom hole pressure builds during the LOT.

The advantages of using the systems and techniques that are described herein in connection with a LOT may include one or more of the following. The sensor measurements may be monitored in real time, have relatively high bandwidths, be associated with relatively fast sampling rates and have relatively high resolutions. The sensor measurements may be acquired downhole internal to the drill string as well as be acquired external to the drill string in the annulus. Real time monitoring of the mud flow at the bit and in the annulus is provided. The measurements acquired downhole and acquired at the surface may be processed in real time using surface processing capabilities. The LOT may be controlled in real time. Real time monitoring and evaluation of the response of the formation is provided. The LOT may be performed in a shorter time than conventional LOTs.

Other variations are contemplated and are within the scope of the appended claims. For example, the drill string 30 may have one or more sensors located near the upper end of the string 30. In this regard, one or more sensors that are located near the upper end of the drill string 30 may measure the incoming flow rate into the central passageway of the string 30. The measurements may be communicated to the surface (to the controller 92, for example) using signals that are communicated over the wired infrastructure 84 of the drill string 30. As another example, one or more of the repeaters 90 may contain sensors (annular pressure sensors, for example) that are connected to the wired infrastructure 84 for purposes of communicating acquired measurements uphole. In general, the sensing devices may be distributed along the drill pipe 30 (at least below the packer 93) and coupled to the wiring infrastructure 84 for purposes of communicating measurements in real time to the surface during the LOT.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

deploying a packer on a drill string in the well wherein at least a portion of the drill string comprises wired drill pipe having a communicative coupler at each pipe joint for transmitting data;

deploying a first sensing device adjacent the packer capable of determining a pressure above the packer;

deploying a second sensing device on the drill string below the packer, wherein at least one of the first sensing device and the second sensing device are in communication with the wired drill pipe;

during a leak off test, communicating first and second signals to a surface controller via the wired drill pipe, the first signal being indicative of a pressure measurement acquired by the first sensing device and the second signal being indicative of a pressure measurement acquired by the second sensing device; and automatically controlling, the leak off test from the surface by automatically controlling a surface pumping system using the surface controller; said automatic control based at least in part on the first and second signals received at the surface controller.

2. The method of claim 1, further comprising determining a fraction initiation pressure in response to the communication.

3. The method of claim 1, further comprising:

communicating additional signals indicative of additional measurements acquired by additional sensing devices over the a wired infrastructure of the drill string and further controlling the leak off test in response to the communication of the additional signals.

4. The method of claim 1, wherein said second sensing device comprises a pressure sensor or a flow rate sensor.

5. The method of claim 1, further comprising using said second sensing device to generate an image of a formation.

6. The method of claim 1, further comprising:

isolating an annular region around the drill string to create an isolated downhole region for the leak off test.

7. The method of claim 6, wherein the isolating comprises setting a packer to form an annular seal about the drill string.

8. The method of claim 7, further comprising:

regulating a pressure differential across the packer during the leak off test, comprising selectively introducing fluid above the packer during the leak off test.

9. A method usable with a wellbore, comprising:

deploying a packer on a drill string in the wellbore wherein at least a portion of the drill string comprises wired drill pipe, wherein at least a portion of the wired drill pipe is configured with a communicative coupler at each pipe joint for transmitting data;

deploying a first sensing device near the packer capable of determining a pressure above the packer;

deploying a second sensing device on the drill string below the packer, wherein at least one of the first sending device and the second sensing device are in communication with the wired drill pipe;

initiating a leak off test;

communicating first and second signals to a surface controller via the wired drill pipe, the first signal being indicative of a pressure measurement acquired by the first sensing device and the second signal being indicative of a pressure measurement acquired by the second sensing device during the leak off test; and automatically controlling the leak off test from the surface by automatically controlling a surface pumping system using the surface controller said automatic control based at least in part on the first and second signals received at the surface controller.

10. A method for conducting a leak off test in a subterranean wellbore, the method comprising:

deploying a drill string in the wellbore, the drill string including wired drill pipe for transmitting data between downhole and surface locations, a drill bit located at a lower end of the drill string, a packer located above the drill bit, a first pressure sensor disposed to measured an annular pressure above the packer, and a second pressure sensor disposed to measure an annular pressure below the packer;

expanding the packer so as to divide an annular region of the wellbore into first and second regions, the first region between the packer and a surface location and the second region between the packer and the drill bit;

causing the first pressure sensor to make a first pressure measurement in the first region;

causing the second pressure sensor to make a second pressure measurement in the second region;

transmitting, at least one signal to the surface location via the wired drill pipe, the signal indicative of said first and second pressure measurements; and controlling the leak off test from the surface location based on the signal transmitted to the surface location via the wired pipe.

11. The method of claim 10, wherein said controlling the leak off test comprises transmitting a control signal from the surface location via the wired drill pipe to at least one of the first and second pressure sensors, the control signal being based on the signal transmitted to the surface location via the wired pipe.

12. The method of claim 10, wherein said controlling the leak off test comprises automatically controlling the leak off test from the surface by automatically controlling a surface pumping system using the surface controller, said automatic control based at least in part on the signal transmitted to the surface location via the wired pipe.

* * * * *